United States Patent [19]

Hagiwara et al.

[11] Patent Number: 4,749,132

[45] Date of Patent: Jun. 7, 1988

[54] METHOD FOR CRUSHING MASSIVE FURNACE SLAG USING A SWINGABLE TYPE CRUSHING APPARATUS

[75] Inventors: Tatsuo Hagiwara, Funabashi; Keiji Imai, Ibaraki; Shigenori Nagaoka, Chiba; Hidenaga Ishii, Tokyo; Toshitsugu Kikuchi, Takasaki, all of Japan

[73] Assignees: Kawasaki Jukogyo Kabushiki Kaisha, Kobe; Ishii Syoji, Ltd., Tokyo, both of Japan

[21] Appl. No.: 905,191

[22] Filed: Sep. 9, 1986

[30] Foreign Application Priority Data

| | | | |
|---|---|---|---|
| Sep. 10, 1985 | [JP] | Japan | 60-200089 |
| Dec. 5, 1985 | [JP] | Japan | 60-273673 |
| Jan. 10, 1986 | [JP] | Japan | 61-3280 |

[51] Int. Cl.[4] ..... B02C 25/00

[52] U.S. Cl. ..... 241/30; 241/37

[58] Field of Search ..... 241/30, 33, 36, 37, 241/264–269

[56] References Cited

U.S. PATENT DOCUMENTS

| | | | |
|---|---|---|---|
| 3,223,334 | 12/1965 | Wüthrich | 241/36 |
| 4,406,412 | 9/1983 | Alexandersson | 241/37 X |

*Primary Examiner*—Timothy V. Eley

*Attorney, Agent, or Firm*—Leydig, Voit & Mayer

[57] ABSTRACT

A control method for crushing massive furnace slag using a swingable type crushing apparatus in which a crushing clearance is increased or decreased in a stepwise manner by a hydraulic mechanism depending on crushing conditions of the massive furnace slag, which may be blast furnace slag, convertor slag, and electric furnace slag. A hydraulic pressure of a hydraulic mechanism is detected as a variable of the crushing conditions and is compared with a set value so as to adjust the crushing clearance.

5 Claims, 7 Drawing Sheets

METHOD FOR CRUSHING MASSIVE FURNACE SLAG USING A SWINGABLE TYPE CRUSHING APPARATUS

BACKGROUND OF THE INVENTION

Most of blast furnace slag, convertor slag and electric furnace slag or the like produced in the processes of iron manufacture and steel manufacture had been disposed by throwing away. However, in recent years because of decrease of reclaimable land and in view of effective utilization of resources, recovery of an iron content from slag and reuse of the slag for aggregate etc. have been practiced.

For such a reason, the applicant has developed a swingable type crushing apparatus. This apparatus enables effectively crushing or deforming the massive furnace slag containing iron whose ratio is as high as more than 50–60% and its dimension is larger than 300–500 mm as disclosed in U.S. Pat. No. 4,637,562. By providing a hydraulic mechanism to this swingable type crushing apparatus, during operation of the crushing or deformation of the massive furnace slag, the movement of the apparatus becomes smooth and an excessive load is not applied on a respective portion of the apparatus, thereby enabling improvement of the function of the apparatus.

In the conventional control method for the above-mentioned swingable type crushing apparatus, when the crushing or deformation of the massive furnace slag is conducted in ordinary operation, compressive force is applied to a swingable crushing plate and in such a condition that a hydraulic pressure is produced in a hydraulic line of a hydraulic mechanism. When the compressive force is less than a maximum supplying pressure of the hydraulic line the operation of the crushing or deformation of the slag is continued, and when the compression force is greater than the maximum of supplying pressure of the hydraulic line the swingable type crushing plate is moved backwardly to increase the crushing clearance under the condition of compressing the massive furnace slag, and the crushing is accomplished and the slag is discharged through an outlet of the crushing chamber.

However, because of the properties and the configuration of the massive furnace slag, even if the normal swing motion is given to the swingable crushing plate, there are occasions that biting effect by the crushing plate against the massive furnace slag within the crushing chamber is not enough to apply appropriate compressing force on the slag. Upon the operation of the apparatus under such crushing circumstances, the contacting locations between the massive furnace slag and the crushing plate in the crushing chamber is changed in such a manner that the crushing clearance is increased or decreased stepwisely to ensure the appropriate biting against the massive furnace slag, so that under the activation of sufficient compressive force the crushing is carried out and finally the crushed slag is discharged through the outlet of the crushing chamber.

At this time, the increasing and the decreasing of the crushing clearance are varied at a ratio of 1/10–1/5 of initial set value, and the massive furnace slag is successively crushed without shutdown of the operation of the swingable type crushing apparatus (disclosed in the aforementioned U.S. Pat. No. 4,637,562).

However, in the above-mentioned method for controlling the operation of the swingable type crushing apparatus, there are problems in monitoring variation in the crushing condition due to the configuration and the properties of the massive furnace slag and also due to tendency of fluctuation of hydraulic pressure in a hydraulic mechanism due to applied compressive force, Furthermore adjustment of the crushing clearance of the swingable type crushing mechanism by increasing or decreasing it stepwisely for controlling operation of the apparatus can not be readily effected.

Especially, after supplying the massive furnace slag into the crushing chamber, when a bridging or adhering phenomenon happens within the crushing chamber between the furnace slag masses in mutual or between the crushing plate and the massive furnace slag, even if hydraulic signals of the hydraulic mechanism exhibit a non-loading condition, the massive furnace slag might still remain in the crushing chamber, and thus the crushing condition of the massive furnace slag is impossible to be monitored correctly.

SUMMARY OF THE INVENTION

The present invention has the objective of resolving these problems, and it is a main object of the present invention to provide a superior automatic operation control method for a swingable type crushing apparatus which is capable of automatic control of operation through the whole process from the beginning point of supplying of the massive furnace slag to the accomplishment of the dischargement of the slag and which also improves the crushing operation of the massive furnace slag.

The present invention is intended for accomplishment of the purpose described above in such a manner that in an automatic operation control method for a swingable type crushing apparatus which regulates a crushing clearance by increasing or decreasing it stepwisely by a hydraulic mechanism depending on a crushing condition of massive furnace slag, a hydraulic pressure of said hydraulic mechanism is detected as representative of variables in crushing conditions and the hydraulic pressure is compared with set values for adjusting the crushing clearance.

According to another embodiment of the present invention, in an automatic operation control method for a swingable type crushing apparatus which regulates a crushing clearance by increasing or decreasing it stepwisely by a hydraulic mechanism depending on a crushing condition of massive furnace slag, it is arranged that a hydraulic pressure of said hydraulic mechanism is detected as variables representing crushing conditions as well as after supplying the massive furnace slag to the swingable type crushing apparatus said hydraulic pressure is compared with set values from the beginning point of the crushing at intervals of a given period of time for adjusting the crushing clearance.

According to still another embodiment of the present invention, in an automatic operation control method for a swingable type crushing apparatus which regulates a crushing clearance by increasing or decreasing it stepwisely by a hydraulic mechanism depending on a crushing condition of massive furnace slag, it is arranged that the massive furnace slag is initially supplied to the swingable type crushing apparatus and the crushing clearance is adjusted from the beginning point of the crushing at intervals of a given period of time.

DESCRIPTION OF THE PREFERRED EMBODIMENT

Figure 1:
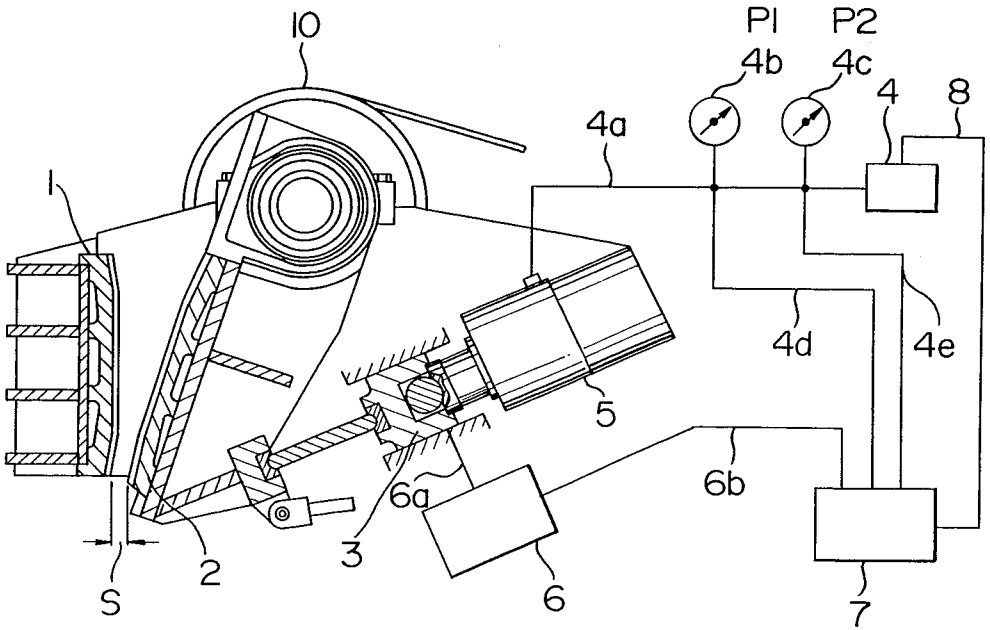
FIG. 1 is a diagrammatical illustration of automatic operation control apparatus for a swingable type crushing apparatus employing a method according to one embodiment of the present invention.

FIG. 1 diagrammatically shows equipment for carrying out an embodiment of the method of the present invention.

In FIG. 1, the reference numeral 10 designates the main part of a swingable type crushing apparatus in which the numerals 1 and 2 exhibit a fixed crushing plate and a swingable crushing plate respectively. The reference character S is a crushing clearance formed by the fixed crushing plate 1 and the swingable crushing plate 2. The numerals 3 and 5 shows a slide block and a hydraulic cylinder respectively, and they are communicated through a hydraulic mechanism 4 and a hydraulic line 4*a*. the reference numerals 4*b* and 4*c* are pressure gauges for measuring hydraulic pressure in a hydraulic line 4*a*. The numeral 6 shows one example of detection means for detecting an amount of displacement of the slide block 3, and the detail structure of such detection means will be seen in FIG. 4. The numeral 7 denotes a control circuit, to which signals such as hydraulic signals 4*d*, 4*e*, a positional signal 6*b* or the like are input, and an output signal 8 of the control circuit 7 in turn controls actuation of a hydraulic mechanism 4. Also, a timing circuit is installed in the control circuit 7.

The actuation of the hydraulic mechanism 4 can cause the crushing clearance S of the swingable type crushing apparatus to vary from MIN (minimum) value to MAX (maximum) value. In this case, the crushing clearance S is shown to be increased at the opening side and the value of the clearance at the closing side is decreased corresponding to respective swinging strokes. The transition of the crushing clearance S from the MIN value to the MAX value upon the displacement of the slide block 3 occurs under step-like increment of the step value, but not in continuous variation of the step value.

Upon the operation of the swingable type crushing apparatus 10, when the crushing or deformation of massive furnace slag is carried out in an usual operation of the apparatus, the massive furnace slag is supplied to the swingable type crushing apparatus 10, and then compressive force is applied to the swingable crushing plate 2. At this time, in the hydraulic line 4*a* of the hydraulic mechanism 4 a hydraulic pressure generates. When the compressive force is less than the maximum supplying pressure of the hydraulic line 4*a* the crushing or deformation is continued. On the contrary, when the massive furnace slag is compressed with a compressive force greater than the maximum applying pressure of the hydraulic line 4*a*, the swingable crushing plate 2 is moved backwardly while the crushing clearance S is increased. In such a condition, the crushing is effected and the slag is discharged through an outlet of a crushing chamber.

However, because of the properties and the configuration of the massive furnace slag, even though the normal swing motion is given to the swingable crushing plate, there are occasions that biting effect by the crushing plate 2 against the massive furnace slag in the crushing chamber is not enough to apply appropriate compressive force on the slag. Upon operation of the apparatus under such crushing circumstances, the contacting positions between the massive furnace slag and the crushing plate in the crushing chamber is changed in such a manner that the crushing clearance S is increased or decreased stepwisely to ensure the appropriate biting against the massive furnace slag, so that under the activation of sufficient compressive force the crushing is carried out and finally the crushed slag is discharged through the outlet of the crushing chamber.

At this time, the crushing phenomenon of the massive furnace slag develops depending on the difference of each particular configuration or properties of the massive furnace slag, and particularly the crushing begins at the boundary portion or the like which has low ratio of iron containing high ratio of slag and low strength.

Figure 2:
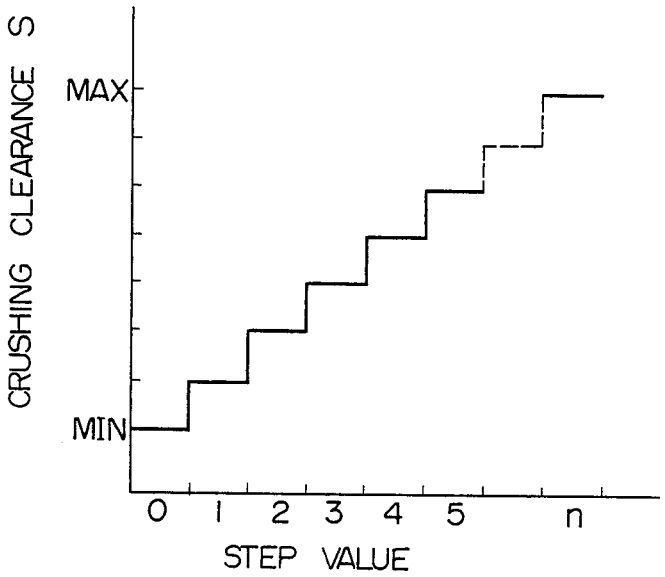
FIG. 2 is an explanatory diagram representing the relation between crushing clearance and step value in the same method.

FIG. 2 shows the relation of crushing clearance S and step value of the swingable type crushing apparatus 10 according to the present invention. In FIG. 2, when the step value shifts such as 0, 1, 2, 3, 4, 5, . . . n, the crushing clearance S also changes stepwisely form the MIN value to the MAX value, and the operation of the swingable type crushing apparatus 10 can be accomplished by the provision of the crushing clearance S corresponding to any step value. In this case as a step value, it is selectively set to be 1/10–1/5 of the difference of between the MAX value and the MIN value of the crushing clearance S.

As mentioned above, during the operation of the swingable type crushing apparatus 10 a hydraulic pressure generates in the hydraulic line 4*a* of the hydraulic mechanism 4. By detecting this hydraulic pressure, variables in crushing conditions are obtained which represent the progress of the crushing or deformation and their difficulties as well as the differences of the configuration and properties of the massive furnace slag.

Thus hydraulic pressure set values are predetermined for conducting automatic operation control. These are a first set value P1, for example 10–30 kg/cm$^2$ and a second set value P2, for example 50–100 kg/cm$^2$. (Ordinarily the running pressure is 200–250 kg/cm$^2$.) The first set value P1 corresponds to a hydraulic pressure which represents that the crushing is not satisfactorily effected because of stagnation or the like of the massive furnace slag at an inlet portion of the swingable type crushing apparatus 10, or that discharge of the slag from the crushing chamber has been completed. On the other hand, the second set value P2 corresponds to a hydraulic pressure indicative of conducting an appropriate compressive operation for the massive furnace slag below the maximum supply pressure of the hydraulic mechanism 4.

Figure 3:
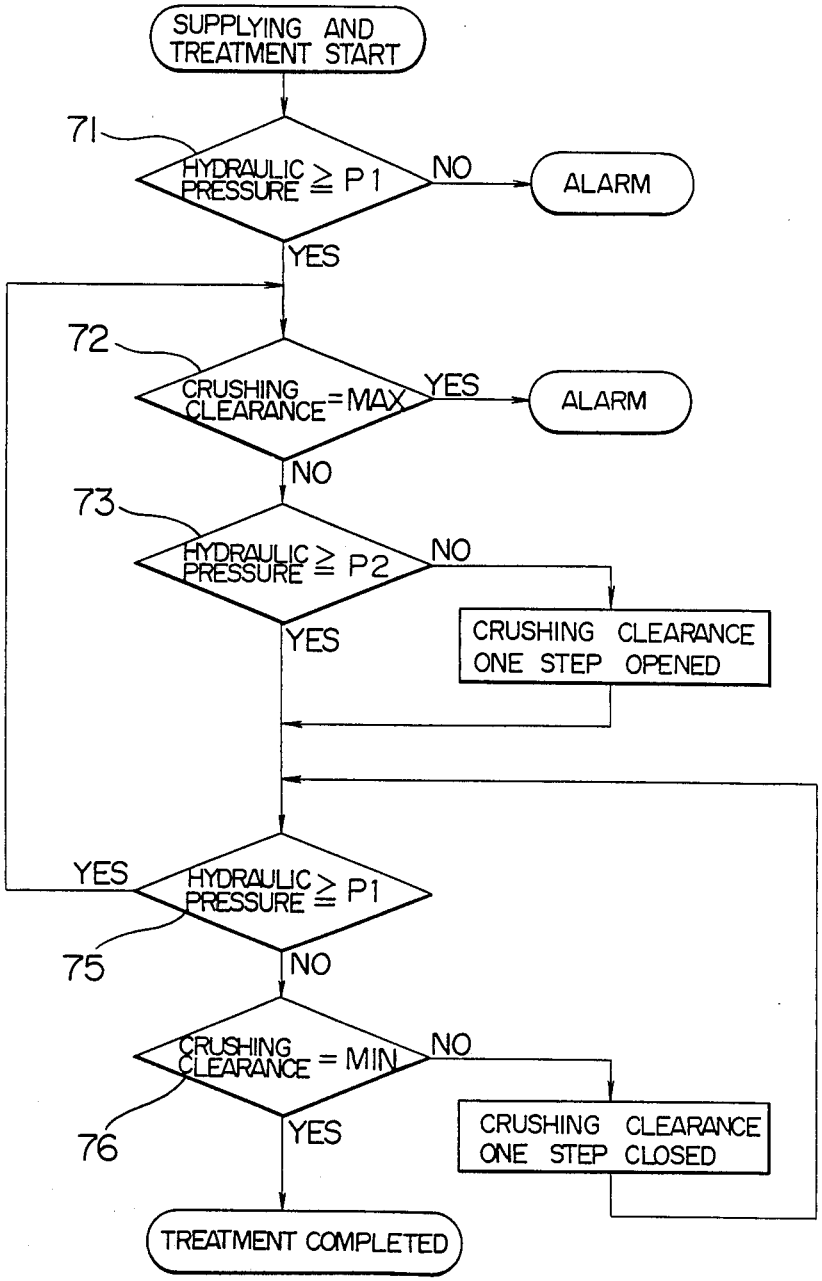
FIG. 3 is a flow diagram of the steps followed in carrying out the method according to this invention.

FIG. 3 is a diagrammatical view of a control circuit for a method according to the present invention, and with reference to FIG. 3 the operation program of the control circuit will be described.

Before starting the automatic operation control program of the swingable type crushing apparatus, the apparatus has already been operated under a no-load condition. When the massive furnace slag is initially supplied, and then, the automatic operation begins, program step 71 determines whether hydraulic pressure P is greater than or equal to that of the first set value P1 or not. In case of NO, the automatic operation control program of the apparatus gives an alarm and stops. Such a condition represents that idling operation was continued while the swingable type crushing apparatus 10 could not bite the massive furnace slag.

When an answer is YES, the program advances to program step 72. The program step 72 determines whether the crushing clearance S is equal to the MAX value or not. Then when the answer is YES, an alarm is generated and the automatic operation control program of the apparatus terminated. Otherwise the control program advances to program step 73.

The program step 73 determines whether the hydraulic pressure is greater than or equal to the second set value P2, and when an answer is YES, the control program advances to program step 75. When the answer is NO, the crushing clearance S is increased one step by a stepwise opening of the hydraulic mechanism 4. The program step 75 determines whether the hydraulic pressure P is greater than or equal to the first set value P1 or not. Then when the answer is YES, the control program is shifted back to the program step 72 and the controlling operation on steps 72 and 73 is thus repeated. When the answer is NO, the control operation advances to a program step 76.

Then the program step 76 determines whether the crushing clearance S is equal to the MIN value or not and when the answer is YES, the operation is completed. When the answer is NO the crushing clearance S is decreased one step by a stepwise closing of the hydraulic mechanism 4, and at the same time the control program is shifted back to the program step 75 to repeat the controlling operation again.

According to the above mentioned embodiment, in the method for automatic operation of the swingable type crushing apparatus, a hydraulic pressure is detected and compared with the set value such as the first set value and the second set value to adjust the clearance in such a manner as stepwisely increasing or decreasing the crushing clearance presented by step value, whereby if the massive furnace slag varies in the configuration and properties the crushing or the like proceeds smoothly during the operation of the crushing or the deformation of the slag. As a result this method greatly improves the functions of process capacity of the crushing apparatus.

Figure 4:
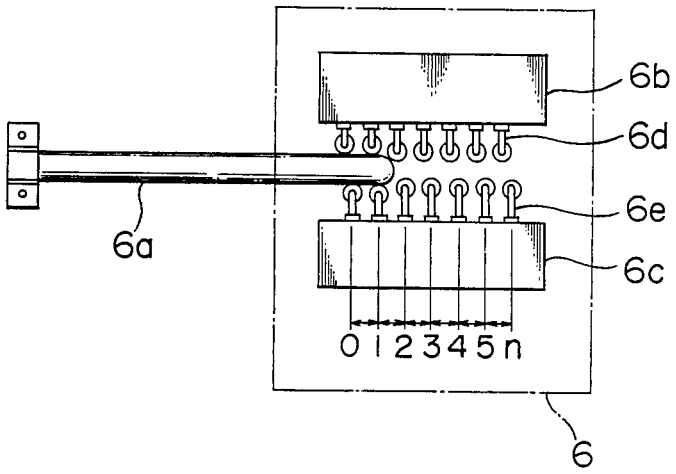
FIG. 4 is a detail view showing detection means for detecting an amount of displacement of a side block used in the method.

FIG. 4 shows an example of the structure of detection means for detecting an amount of displacement of a slide block 3.

In FIG. 4, the reference numeral 6 designates detection means and the numeral 6*a* exhibits a dog which is connected to the slide block 3 and moves integrally with this slide block. The numerals 6*b* and 6*c* are mounting bases for limit switches 6*d* and 6*e* respectively. These bases and the detection means 6 are mounted on fixed positions of the swingable type crushing apparatus. The limit switches 6*d* and 6*c* are set in pairs oppositely at the locations corresponding to the respective step values 0, 1, 2, 3, 4, 5 . . . n. The dog 6*a* moves the actuates to push or release the limit switches 6*d* and 6*e*. Thus, when the dog does not push the limit switch an electrical connection can not be obtained. In addition, by providing the limit switches in pairs oppositely at the locations corresponding to the step values such an arrangement permits to prevent the electric circuit from a nonstable operation which often occurs when using a signal limit switch, thereby ensuring a reliable for the hydraulic mechanism 4.

Next, another embodiment of the present invention will be explained with reference to FIG. 5.

A swingable type crushing apparatus used in this embodiment is substantially the same as that used in the embodiment explained in conjunction with FIG. 3. Therefore the explanation relative to FIGS. 1 through 4 are also applicable to this embodiment, and the same reference numerals show the equal or the same portions respectively.

Figure 5:
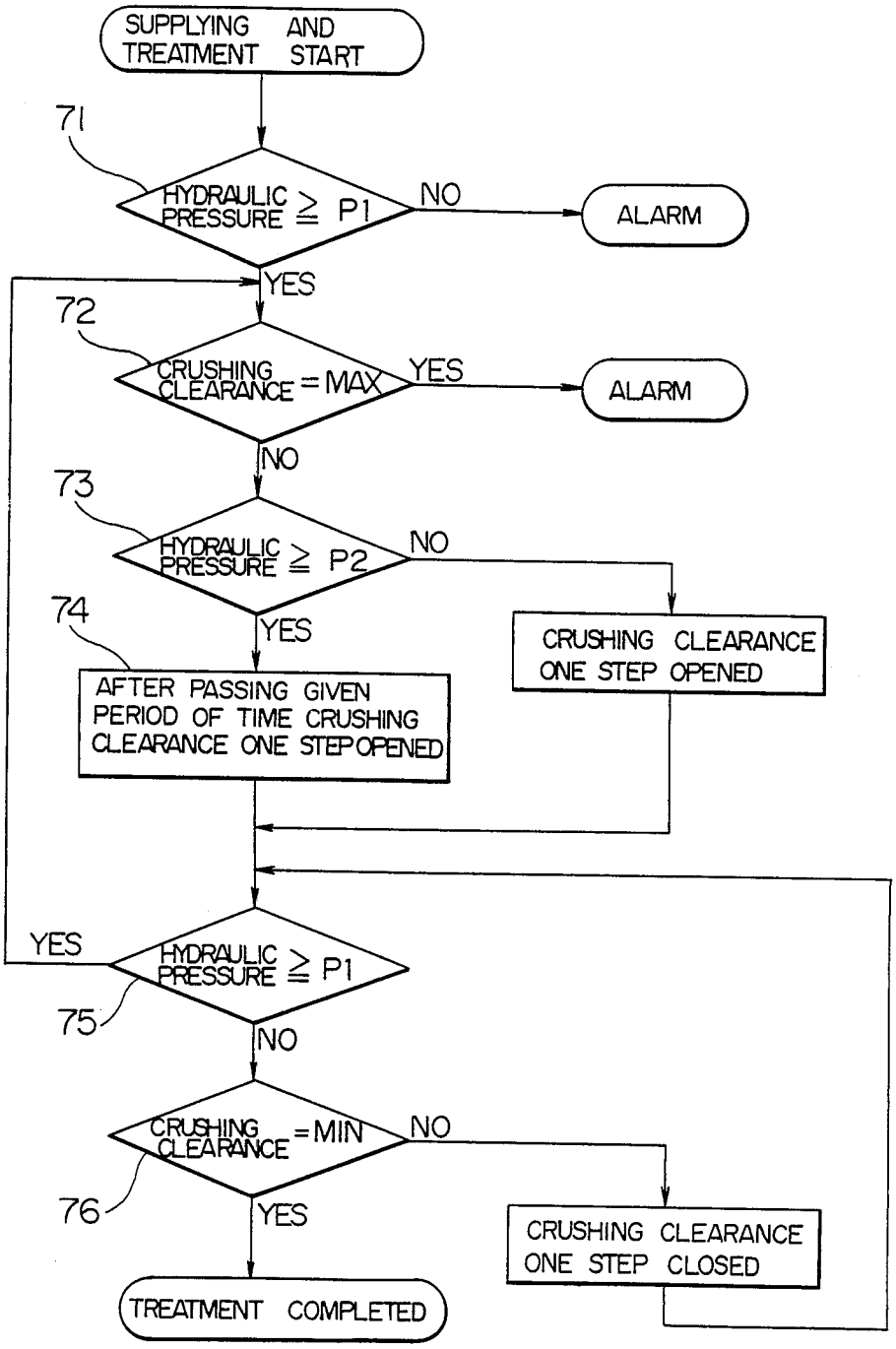
FIG. 5 is a flow diagram of the steps followed in carrying out another embodiment of the method according to this invention.

As readily understood upon comparing FIG. 5 with FIG. 3, this embodiment differs from the embodiment mentioned previously in that an additional program step 74 is carried out between operations of program step 73 and 75.

The program step 73 determines whether the hydraulic pressure is greater than or equal to the second set value P2 or not. When the answer is YES the control program shifts to program step 74. When the answer is NO, the crushing clearance S is increased one step by the stepwise opening of the hydraulic mechanism 4.

In this way the program step 74 permits the crushing to begin, after passing a given period of time from the time the crushing clearance is increased by one step.

The program step 75 determines whether the hydraulic pressure is greater than or equal to the set value P1 or not. When the answer is YES, the program returns to program step 72 and the controlling is repeated. When the answer is NO, the control program advances to the program step 76.

Thus according to the above-mentioned embodiment, in the method for automatic operation of the swingable type crushing apparatus, initially the massive furnace slag is supplied to the apparatus and the crushing conditions are recognized by the hydraulic pressures generated in the hydraulic line of the hydraulic mechanism so that the crushing clearance can be successively controlled at intervals of a given period of time. Even if the massive furnace slag varies in configuration and properties, during the operation of crushing and deformation, occurrence of bridging and adhering phenomena caused by the furnace slag masses and also caused between the massive furnace slag and the crushing plate is avoided to conduct the biting action smoothly, whereby said method enables to greatly improve the functions such as a process capacity remarkably.

In the embodiments described hereinbefore, when the massive furnace slag is supplied into the swingable type crushing apparatus to conduct the crushing or deformation of the massive furnace slag, the crushing conditions are recognized by the hydraulic pressures generated in the hydraulic line of the hydraulic mechanism for the swingable type crushing apparatus, and continuously the crushing clearance is increased stepwisely at intervals of a given period of time for advancing the crushing, then after finishing of the crushing successively the crushing clearance is decreased stepwisely at intervals of a given period of time. Furthermore, in the case where bridging and adhering phenomena caused by the furnace slag masses in mutual and also caused between the crushing plate and the slag occurs in the crushing chamber after supplying the massive furnace slag into the crushing chamber, even though the hydraulic signals in the hydraulic line exhibit a non-loading condition the massive furnace slag still remains in the crushing chamber. Under these circumstances, the crushing clearance is decreased stepwisely at intervals of a given period of time. In this process when the hydraulic signals of the hydraulic line indicate a loading condition, the crushing clearance is again increased stepwisely to continue the crushing, so that the occurrence of aforesaid bridging and adhering phenomena caused by the massive furnace slag is avoided, whereby the automatic operation control is carried out in such a manner that the dimensions of the massive furnace slag are gradually reduced under the condition of smooth flowing down of the slag within the crushing chamber to finish the crushing.

Therefore, the tendency of the change in crushing condition of the massive furnace slag can be monitored exactly and repeatedly, and because the crushing clearance is always controlled stepwisely at the intervals of the given period of time to continue the crushing, the contacting location of the massive furnace slag within the crushing chamber may be adjusted appropriately so as to surely effect the crushing, so that the crushing carries out under the sufficient pressure force and the dimensions of the slag will be reduced. Also, even though the variation may be seen in the configuration and the properties of the massive furnace slag it is possible to remarkably improve the function of the crushing operation.

Figure 6:
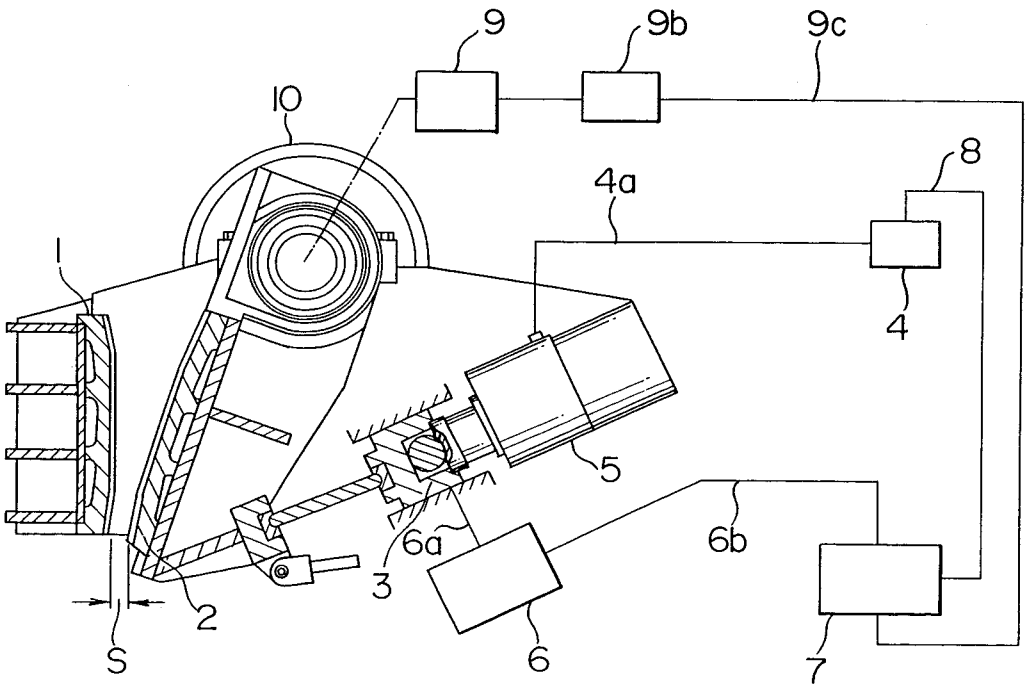
FIG. 6 is a diagrammatical illustration of control apparatus for a swingable type crushing apparatus employing a method according to still another embodiment of the present invention.
Figure 7:
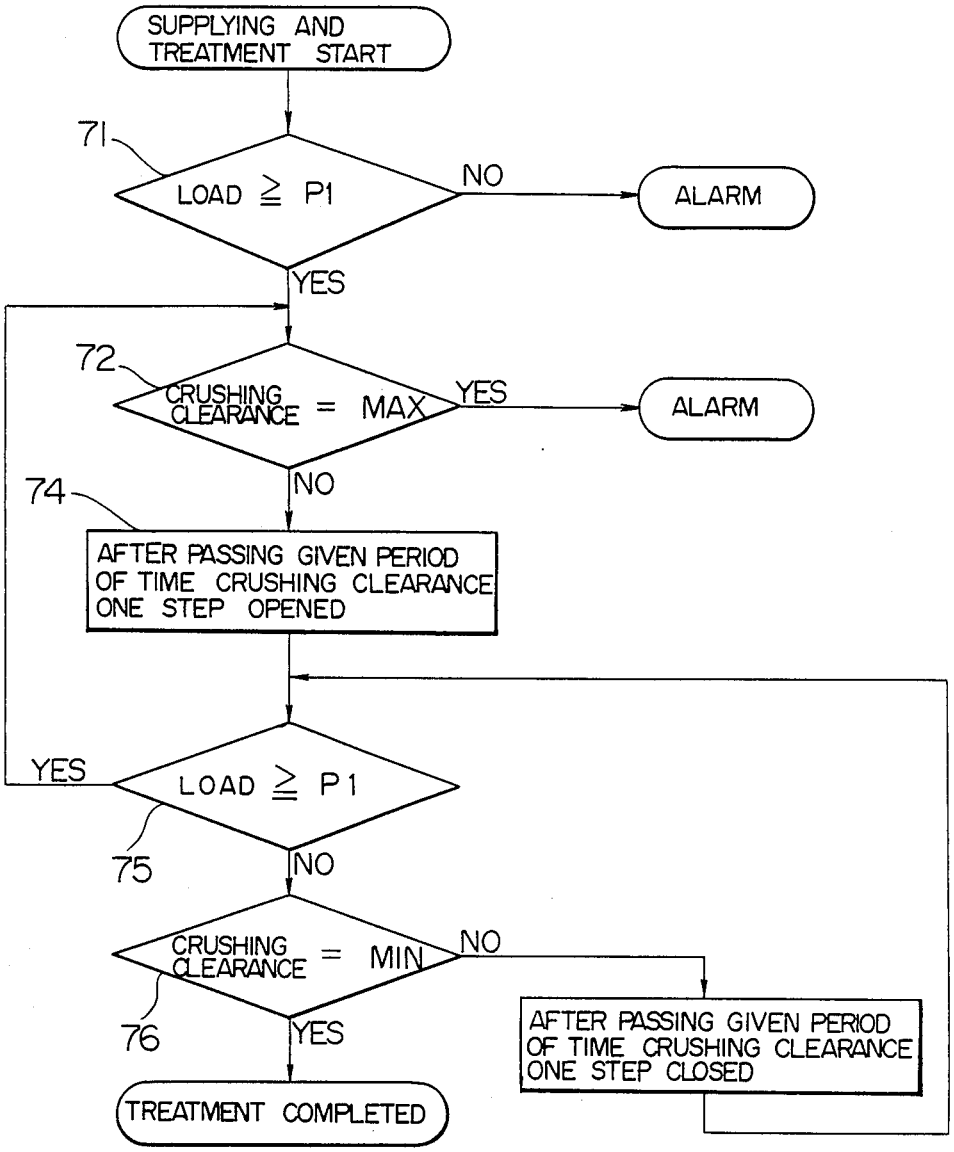
FIG. 7 is a flow diagram of the steps followed in carrying out the embodiment of the invention referred to in FIG. 6.

Next, still another embodiment of the present invention will be explained with reference to FIGS. 6 and 7. In these drawings the same reference numerals used in FIGS. 1 to 5 exhibit the same or the equal portions respectively.

The difference in this embodiment compared with FIG. 5 resides in that the decision means to compare a hydraulic pressure with a pressure force P2 is not employed in this embodiment, though it was utilized in the above-mentioned embodiments, and a program step 74 in which a crushing clearance is increased by one step at intervals of a given period of time from the beginning of operation of the crushing apparatus is established.

That is, in this embodiment, before starting the automatic operation of the swingable type crushing apparatus 10, the apparatus has already been operated under a non-loading condition. When the massive furnace slag is initially supplied, and then the automatic operation begins, program step 71 determines whether a load is greater than or equal to the set value P1 or nôt. When an answer is NO, the automatic operation gives an alarm and stops. Such a condition represents that idling operation was continued while the swingable type crushing apparatus 10 could not bite the massive furnace slag.

When an answer is YES, the control program advances to a program step 72. The program step 72 determines whether the crushing clearance S is equal to the MAX value or not. When the answer is YES, the automatic operation gives an alarm and stops.

Above-mentioned matter is substantially the same as the embodiments described before, but in this embodiment when the answer is NO the program step 74 is different from the program step 74 shown in FIGS. 3 and 5.

In this manner the program step 74 is at the beginning point of the crushing, and timing circuit operates so as to increase the crushing clearance S by one step after passing a given period of time given to the hydraulic mechanism 4.

The program step 74 determines whether a load is larger than the set value P1 or not. When the answer is YES, the program returns to the program step 72 and the controlling is repeated. When the answer is NO, the program advances to the program step 75.

Then, the program step 75 determines whether the crushing clearance S is equal to the MIN value, and when the answer is YES the operation finishes. When the answer is NO, the crushing clearance is decreased by one step and simultaneously the control program returns to the program step 74 to repeat the controlling operation.

In this way according to the above-mentioned embodiment, in the method for automatic operation of the swingable type crushing apparatus, firstly the massive furnace slag is supplied to the apparatus, and then the crushing clearance may be adjusted continuously at the intervals of the present period of time from the beginning point of the crushing, even if wide variation is seen in the configuration and the properties of the massive furnace slag, during the operation of the crushing or deformation, the occurrence of the bridging and adhering phenomena caused by the furnace slag masses in mutual and also caused between the massive furnace slag and the crushing plate is avoided to conduct the operations such as the biting action smoothly so that the process capacity of the apparatus becomes enlarged, whereby the present method enables the functions improved remarkably.

As explained hereinbefore, the present invention employs a relatively simple structure. Even though the configuration and the properties of the massive furnace slag change, the occurrence of the bridging and adhering phenomena caused mutually by the furnace slag masses and also caused between the massive furnace slag and the crushing plate during the operation of the crushing or deformation is avoided to conduct the biting action smoothly so that the process capacity of the apparatus becomes enlarged, whereby said method enables to conspicuously improve the functions and the various advantages and effects can be expected.

Moreover, there is no doubt that the constitution or mode of the swingable type apparatus, the detection means and the loading signal etc., utilized in the present invention is not limited to those used in the above-mentioned embodiments, but for example, a hydraulic signal may be used as a load signal.

What is claimed is:

1. A method of crushing massive furnace slag using a swingable type crushing apparatus having a hydraulic mechanism for adjusting crushing clearance, said method comprising the steps of:

detecting a hydraulic pressure of said hydraulic mechanism during a crushing operation, comparing the detected hydraulic pressure with set values representing predetermined conditions of the crushing operation which represent the progress of the crushing operation as well as differences in the configuration and properties of the slag, and adjusting the hydraulic mechanism to increase and decrease the crushing clearance in a stepwise manner so as to maintain the hydraulic pressure within a range determined by the set values.

2. A method of crushing massive furnace slag using a swingable type crushing apparatus according to claim 1, said method further comprising the step of comparing the detected hydraulic pressure of said hydraulic mechanism with the set values from a beginning point of the crushing operation at intervals of a given period of time and producing a determination for adjusting said hydraulic mechanism to increase or decrease the crushing clearance in a stepwise manner.

3. A method of crushing massive furnace slag using a swingable type crushing apparatus having a hydraulic mechanism for adjusting crushing clearance, comprising the steps of:

detecting a hydraulic pressure of said hydraulic mechanism during a crushing operation, comparing the detected hydraulic pressure with set values representing predetermined conditions of the crushing operation, and adjusting the crushing clearance from a beginning point of the crushing operation at intervals of a given period of time so as to maintain the hydraulic pressure within a range determined by the set values.

4. A method of crushing massive furnace slag using a swingable type crushing apparatus having a hydraulic mechanism for adjusting crushing clearance, said method comprising the steps of:

detecting a hydraulic pressure of said hydraulic mechanism during a crushing operation, determining a first set value which corresponds to a hydraulic pressure representing the condition that the crushing operation is not satisfactorily effected because of one of (a) stagnation of the massive furnace slag at an inlet portion of the swingable type crushing apparatus and (b) complete discharge of the slag from the crushing chamber, and a second set value which corresponds to a hydraulic pressure representing the condition that a satisfactory crushing operation is effected for crushing of the massive furnace slag and that is below a maximum supply pressure of the hydraulic mechanism, and carrying out the crushing operation including adjusting said hydraulic mechanism to increase and decrease the crushing clearance in a stepwise manner so as to maintain the hydraulic pressure in a range determined by the first and second set values.

5. A method of crushing massive furnace slag using a swingable type crushing apparatus having a hydraulic mechanism for adjusting crushing clearance, said method comprising the steps of:

detecting a hydraulic pressure of said hydraulic mechanism during a crushing operation, comparing the detected hydraulic pressure with set values representing predetermined conditions of the crushing operation, which represent the progress of the crushing operation as well as differences in the configuration and properties of the slag, from a beginning point of the crushing operation at intervals of a given period of time and producing a determination for adjusting the crushing clearance, and increasing the crushing clearance in a stepwise manner at said intervals from the beginning point of the crushing, and decreasing the crushing clearance in a stepwise manner when a bridging or adhering phenomenon occurs in the slag based upon the determination.

* * * * *